US005917184A

United States Patent [19]

Carson et al.

[11] Patent Number: 5,917,184

[45] Date of Patent: Jun. 29, 1999

[54] INTERFACE BETWEEN LIQUID FLOW AND MASS SPECTROMETER

[75] Inventors: William W. Carson, Hopkinton; Stephen C. Gabeler, Sudbury; Yin Liang F. Hsieh, Lexington; Stephen A. Martin, Belmont, all of Mass.; Michael J. Tomany, Thompson, Conn.; Anotoli Verentchikov, Watertown, Mass.

[73] Assignee: PerSeptive Biosystems, Framingham, Mass.

[ * ] Notice: This patent issued on a continued prosecution application filed under 37 CFR 1.53(d), and is subject to the twenty year patent term provisions of 35 U.S.C. 154(a)(2).

[21] Appl. No.: 08/797,088

[22] Filed: Feb. 7, 1997

Related U.S. Application Data

[60] Provisional application No. 60/011,358, Feb. 8, 1996.

[51] Int. Cl.[6] ..... H01J 49/10

[52] U.S. Cl. ..... 250/288

[58] Field of Search ..... 250/288, 288 A, 250/281, 282

[56] References Cited

U.S. PATENT DOCUMENTS

| | | | |
|---|---|---|---|
| 4,209,696 | 6/1980 | Fite | 250/281 |
| 4,403,147 | 9/1983 | Melera et al. | 250/288 |
| 4,842,701 | 6/1989 | Smith et al. | 204/180.1 |
| 4,861,988 | 8/1989 | Henion et al. | 290/288 |
| 4,885,076 | 12/1989 | Smith et al. | 204/299 R |
| 4,963,736 | 10/1990 | Douglas et al. | 250/288 |
| 4,977,320 | 12/1990 | Chowdhury et al. | 250/288 |
| 4,994,165 | 2/1991 | Lee et al. | 204/299 R |
| 5,171,990 | 12/1992 | Mylchreest et al. | 250/288 |
| 5,223,226 | 6/1993 | Wittmer et al. | 422/100 |
| 5,393,975 | 2/1995 | Hail et al. | 250/288 |
| 5,412,208 | 5/1995 | Lovey et al. | 250/288 |
| 5,448,062 | 9/1995 | Cooks et al. | 250/288 |

FOREIGN PATENT DOCUMENTS 0 444 896 A2 4/1991 European Pat. Off. .

OTHER PUBLICATIONS

Smith et al., "Capillary Electrophoresis Mass Spectrometry," *Analytical Cheistry*, 4(13):574–584 (Jul. 1, 1993).

Smith et al., "Improved Electrospray Ionization Interface for Capillary Zone Electrophoresis–Mass Spectrometry," *Analytical Chemistry*, 60(18):1948–1952 (Sep. 15, 1988).

Smith et al., "Capillary Zone Electrophoresis–Mass Spectrometry Using an Electrospray Ionization Interface," *Analytical Chemistry*, 60(5):436–441 (Mar. 1, 1988).

Pleasance et al., "Comparision of liquid–junction and coaxial interfaces for capillary electrophoresis–mass spectrometry with application to compounds of concern to the aquaculture industry," *Journal of Chromatography*, 591:325–339 (1992).

*Primary Examiner*—Kiet T. Nguyen

*Attorney, Agent, or Firm*—Testa, Hurwitz & Thibeault, LLP

[57] ABSTRACT

An interface apparatus for introducing a sample for analysis from a liquid flow into a mass spectrometer as a plurality of charged droplets is disclosed. The interface apparatus includes interface body which defines a spray chamber and an orifice, a spray means defining a liquid-flow inlet channel and an excess-sample-flow exit channel and having an open end disposed inside the spray chamber, and a voltage device for applying a voltage to the sample to form a plurality of charged droplets. The charged droplets pass through the orifice in the interface body and are introduced into a mass spectrometer for analysis. The interface includes a valve for regulating the flow of sample into the sample inlet channel and a device for imposing a pressure gradient on the sample at the open end which induces the sample to flow from the sample inlet channel through the excess sample outlet channel.

3 Claims, 8 Drawing Sheets

INTERFACE BETWEEN LIQUID FLOW AND MASS SPECTROMETER

This application claims priority on U.S. Provisional Application No. 60/011,358, filed on Feb. 8, 1996.

FIELD OF THE INVENTION

The present invention relates to an interface apparatus which introduces a sample from a liquid flow into a mass spectrometer as a plurality of charged droplets.

BACKGROUND OF THE INVENTION

Mass spectrometry (MS) is a well known technique for obtaining qualitative and quantitative information from a sample. It is commonly used to determine molecular weight, identify chemical structures and accurately determine the composition of mixtures. Mass spectrometry is becoming increasingly important in biological research to determine the structure of organic molecules based upon the fragmentation pattern of ions formed when sample molecules are ionized. Using mass spectrometry, individual molecules of a sample are weighed by ionizing the molecules and measuring the trajectory of their response in a vacuum to various electric and magnetic fields. However, traditional techniques, such as electron ionization or the evaporation process associated with classical chemical ionization, often damage the molecule under analysis, thereby severely limiting the compounds which can be analyzed by mass spectrometry.

Improved ionization techniques have been developed, such as fast atom bombardment, thermospray, electrospray, and atmospheric pressure chemical ionization which produce intact molecular ions from high molecular weight, ionic and thermally labile molecules. As a result, mass spectrometry has become increasingly important for many new applications such as biological research, where detection and characterization of high molecular weight molecules is required.

Many different kinds of mass spectrometry are known in the art. Quadrupole mass spectrometry is commonly used in conjunction with electrospray. Although quadrupole systems provide good sensitivity, they are useful only for a limited mass range. Similarly, magnetic sector mass spectrometry systems are frequently used; although they provide accurate mass information, they have poor sensitivity.

Time-of-flight (TOF) mass spectrometers separate ions according to their mass-to-charge ratio by measuring the time it takes generated ions to travel to a detector. Time-of-flight mass spectrometers are advantageous because they are relatively simple, inexpensive instruments with virtually unlimited mass-to-charge ratio range. They have potentially higher sensitivity than scanning instruments because they can record all the ions generated from each ionization event. Time-of-flight mass spectrometers are particularly useful for measuring the mass-to-charge ratio of large organic molecules where conventional magnetic field mass spectrometers lack sensitivity. See, for example, U.S. Pat. Nos. 5,045,694, 5,160,840 and U.S. Ser. Nos. 08/488,127 and 08/446,544, specifically incorporated by reference.

Mass spectrometers include an ionization source for generating ions from the sample material under investigation. The ionization source contains one or more electrodes or electrostatic lenses for accelerating and properly directing an ion beam. Electrospray ionization is frequently used to obtain molecular weight information on large biopolymers, such as proteins. In electrospray, a sample solution containing molecules of interest is directed through a capillary tube and into an electrospray chamber. The end of the capillary tube is connected to a high voltage source and a voltage is applied to generate a fine spray of charged droplets. The droplets may be sprayed into a chamber and then introduced into a mass spectrometer for analysis.

These prior electrospray techniques, however, are only able to accommodate a very narrow range of liquid flow rates, generally in the range of microliters per minute. Thus, to accommodate faster flow rates it is necessary to render the flow rates compatible with droplet formation, ion creation and isolation processes.

Additionally, with larger liquid flow rates, such as those often associated with liquid chromatography, it is very difficult, if not impossible, to generate a spray of droplets by electrospray alone without a pneumatic assist, use of splitter and/or the addition of heat.

Systems for combining mass spectrometry and liquid chromatography have been described. (See, for example, U.S. Pat. No. 4,209,696). In these systems, carrier liquid from a liquid chromatograph is electrosprayed or pneumatically assisted electrosprayed and then analyzed by mass spectrometry. Unfortunately, these systems suffer significant limitations due to incompatible flow rates, and the complexity of splitters necessary for analysis or separation. Moreover, substantially all liquid chromatography effluents contain some non-volatile material, typically in the form of buffers, impurities, or sample residue. When a liquid chromatography solvent is vaporized, this non-volatile material is deposited on the interior of the mass spectrometer, causing a reduction in performance. Accordingly, a major problem with liquid chromatography/mass spectrometer interfaces is the disposal of solvent vapor, which, in addition to instrument contamination, produces hazardous organic vapor. Devices of the art typically attempt to address this problem by supplying heat to prevent condensation, and by diluting vaporized solvent with a dry gas.

Liquid chromatography effluents introduced into an interface may also be incompatible with efficient electrospray ionization, particularly at high flow rates. For example, sample solutions often contain high concentrations of trifluoroacetic acid, which makes it difficult to maintain stable electrospray.

Problems also exist when coupling lower flow rates, such as those associated with capillary electrophoresis with a mass spectrometry system. Capillary electrophoresis is used for a wide variety of analyses including high resolution separations of amino acids, peptides and proteins. Capillary electrophoresis employs a capillary with an electric field gradient to separate the analyte constituents, particularly ions, by differences in electrophoretic mobilities. Capillary electrophoresis detection to date has been limited by the necessity of maintaining the quality of the separation, may require use of liquid solutions which are poorly compatible with electrospray requirements. Thus, most detectors to date have been optical detectors based on UV absorbance and fluorescence emission. Structural information necessary for the correct identification of unknown analytes and their constituents cannot be obtained using traditional detectors, and off-line analysis is impractical because of the small sample volume.

Mass spectrometry is particularly suited for detection of capillary electrophoresis eluents with high sensitivity and selectivity. Although systems have been previously described for coupling capillary electrophoresis with detection by a mass spectrometer, these systems suffer from problems such as poor sensitivity, and band broadening of the separated species due to the discrepancy of flow rates between the electrophoretic separator and the flow rates required to electrospray a sample into a mass spectrometer. (See Smith et al., Anal. Chem. 60:436–441 (1988)).

The ability of a mass spectrometer system to sample ions produced by electrospray is limited by the ability of the system to accommodate non-volatile neutrals and solvent vapor. The use of larger or more efficient vacuums or extensive heating of the interface may increase the ability of the system to accommodate such contaminants. However, non-volatiles and solvent vapor ultimately reduce efficiency, especially at high flow rates.

There are various types of electrophoresis/mass spectrometry interfaces which have been tried in the art. For example, a capillary electrophoresis system may be directly interfaced with a mass spectrometry system wherein substantially all of the sample from the CE is electrosprayed. Although these systems have good sensitivity, there are inherent problems such as difficulties in maintaining electrical continuity, thus resulting in poor stability, modification of the sample by electrochemical reaction by-products, and differences in the optimum chemical conditions for capillary electrophoresis and electrospray. Moreover, typical CE buffers introduce high chemical noise and suppress ionization efficiency.

Thus, although it is desirable to combine the high separation efficiencies of capillary electrophoresis with the inherent sensitivity of mass spectrometry, low flow rates are hard to interface without excessive band spreading, and it is difficult to generate chromatographic gradients at low flow rates Similarly, it is desirable to combine the advantages of a high flow rate chromatography system with the sensitivity of mass spectrometry. However, high flow rates are incompatible with electrospray, and known interfacing techniques are time consuming, difficult to implement, and limited in the range of flow rates which can be accommodated. Furthermore, it is difficult to preserve the liquid chromatography separation, avoid clogging problems, and avoid wasting sample.

Accordingly, a need remains for an interface apparatus and a sample analysis method that allows an electrospray ionization technique to be used with a wide range of flow rates, such as those associated with chromatography and electrophoresis separation devices, without reducing the sensitivity of the analysis, without broadening chromatographic peaks (i.e., with no dead volume), and without wasting limited sample, and without the need for additional specialized equipment.

SUMMARY OF THE INVENTION

The present invention relates to devices for introducing a liquid flow into a mass spectrometer. A device according to the invention comprises an inlet channel having at least one opening for acceptance of a liquid flow from, e.g. an electrophoresis or chromatography apparatus, and an end for introducing at least a portion of the liquid flow into a mass spectrometer. The device further comprises an exit channel having a first end in communication with said inlet channel, and a second end for removal of excess liquid flow. Typically, pressure (e.g. a pump or syringe) is used to force the liquid flow through the inlet channel. The end of the inlet channel for introduction of liquid flow into a mass spectrometer preferably terminates in an electrospray device (e.g. an electrospray needle) for creation of charged particles of the liquid flow for introduction into the mass spectrometer. Interaction of a liquid flow with the inlet channel and exit channel allows for regulation of the flow rate into the mass spectrometer regardless of the source of the flow (e.g. whether it is from a capillary electrophonesis device, chromatography device, etc.).

In a preferred embodiment, a device of the invention comprises an interface apparatus for introducing a sample for analysis from a liquid flow into a mass spectrometer as a plurality of charged droplets (converted into analyte ions as a result of charged aerosol evaporation), or ions wherein the flow rates of the liquid flow and the sample flow into the mass spectrometer can be independently regulated. An apparatus of the invention comprises a housing (interface body) which defines a spray chamber having an orifice for introducing a sample to a mass spectrometer. The charged droplets or ions pass through the orifice and into the mass spectrometer for analysis. The interface apparatus also comprises a spray housing which defines a liquid-flow inlet channel and an excess liquid-flow exit channel. The spray housing has an open end disposed inside the spray chamber. The apparatus further comprises means for applying a voltage to a liquid flow at the open end of the spray housing. The voltage transforms at least a portion of the liquid flow into a plurality of charged droplets.

The present invention allows optimization of an electrospray system for a given mass spectrometer. This allows the entire interface system to operate at near maximum sensitivity over a wide range of flow rates and liquid compositions. The problems discussed above are overcome by methods of the invention, in part, because the flow of vaporized liquid is maintained at a constant low level (typically less than about 1 $\mu$l/min.) independent of the input flow.

In certain embodiments, a pressure gradient is imposed on the liquid flow at the open end of the spray housing in order to induce at least a portion of the liquid flow to flow from the liquid-inlet channel through the excess liquid-flow exit channel.

The sample introduced into the mass spectrometer can be in many forms, for example, in some embodiments, the sample introduced into the mass spectrometer is a plurality of charged droplets expelled from the spray housing, in other embodiments, the sample comprises ions generated from the plurality of charged droplets.

The interface of the invention may further comprise a means for regulating the flow of liquid into the liquid-flow inlet channel, such as, for example, a valve or a pump.

In some embodiments, the spray housing comprises an electrospray needle capillary, and the inlet channel is a capillary which may be made of fused silica, for example, disposed inside the electrospray needle. The outside wall of the capillary and the inside wall of the electrospray needle may define the excess liquid-flow exit channel. The electrospray needle defines a spray orifice about 1 micron to about 200 microns in diameter. In still other embodiments, the means for applying voltage to the liquid flow is a metal coating on the electrospray needle or is the liquid flow itself, which may be exposed to a metal capillary, union, or an electrode in the inlet or exit channel.

In certain embodiments, the spray chamber is sealed and pressurized by regulating the flow of a gas into the spray chamber or by opening and closing a pressure-relief orifice defined by the interface body. The liquid-flow inlet channel may receive at least a portion of the liquid flow from a separation system, such as, for example, a liquid chromatography system, or an electrophoretic separation system.

An interface device of the invention may be manufactured on a microchip, wherein channels embedded on the chip provide conduits for micro-flow of liquids produced in small amounts from an electrophoresis or other apparatus.

Another aspect of the invention relates to methods for the detection and analysis of an analyte in a sample solution which comprises the following steps: introducing a liquid flow into an apparatus of the present invention; applying a voltage to the liquid flow at the open end of the spray means to form a plurality of charged droplets; and introducing sample generated from the charge droplets into a mass spectrometer.

In certain embodiments, the components in the liquid flow may first be separated by any separation system, such as, for example, liquid chromatography, or electrophoresis.

In some embodiments, the spray means of the apparatus may be an electrospray needle. A capillary disposed in the electrospray needle may, in some embodiments, define the liquid-flow inlet channel while the outer surface of the capillary and the inner surface of the electrospray needle define the excess liquid-flow exit channel.

The step of applying a voltage may be accomplished by applying a voltage to a metal coating on the spray housing that is in electrical communication with the liquid flow at the open end of the spray means. Alternatively, a voltage may be applied directly to the liquid flow, for example, by placing an electrically conductive material in electrical contact with the liquid flow in either the liquid-flow inlet channel or the excess liquid-flow exit channel.

The sample introduced into the mass spectrometer may be in any suitable form, such as, for example, a plurality of charged droplets formed at the open end of the spray housing, ions generated from the plurality of charged droplets, or ice droplets formed by cooling the plurality of charged droplets.

In still other embodiments, a method may further include the step of imposing a pressure gradient on the liquid flow at the open end of the spray housing to induce the liquid to flow from the liquid-flow inlet channel through the excess liquid-flow exit channel. The pressure gradient may be imposed by any suitable means, such as variations arising from the surface tension of the liquid flow over different surfaces, adjusting the introduction of gas into the spray chamber, or opening a pressure-relief orifice in the spray chamber. Similarly, although not a preferred method, it is possible to impose a pressure gradient by applying hydrostatic pressure to the liquid-flow inlet or excess liquid-flow exit channels or introducing a physical impedance in the liquid-flow inlet or excess liquid-flow exit channels.

The apparatus may, in some embodiments, comprise a mass spectrometer and the interface apparatus as described above. In other embodiments, the claimed apparatus may comprise a liquid chromatography device and the interface apparatus described above. In still other embodiments, the apparatus of the invention may comprise a liquid chromatography system, a mass spectrometer, and the interface apparatus described above.

In another preferred embodiment, an apparatus of the invention comprises an interface body defining a spray chamber and an orifice for introduction of a sample into a mass spectrometer; a spray housing having an open end and being disposed within the chamber. The spray housing further comprises first and second inlet channels, and an exit channel. The apparatus further comprises means for creating a pressure differential between the open end and the exit channel; and means for applying a voltage to form charged droplets in a liquid applied in the apparatus.

In another aspect, the invention relates to a method for the on-line trapping and analysis of a liquid flow comprising the steps of: interrupting an on-line liquid flow to the claimed interface apparatus; applying or maintaining a voltage to the open end of the spray means to form, or continue to form, a plurality of charged droplets; introducing a plurality of sample droplets or ions into a mass spectrometer; drawing additional liquid flow from the excess liquid-flow exit channel and introducing a sample thereof into the mass spectrometer.

In yet other aspects, the present invention relates to a method for the automated sequencing of at least a portion of a protein or peptide comprising a plurality of residues. There are numerous ways to practice the method by creating for example, a ladder sequence, or degrading a portion of the molecule. In one embodiment, one provides a solid support having the protein or peptide immobilized thereon; eliminates the terminal residue of the protein or peptide; introduces a liquid flow comprising the terminal residue into an apparatus of the present invention; applies a voltage to said liquid flow at the open end of the spray housing to form a plurality of charged residue droplets; introduces a sample of the charged sample residue droplets into a mass spectrometer; and determines the identity of the terminal residue.

The protein or peptide may be immobilized on the solid support by any suitable means, such as, for example, covalent bonds, hydrophobic interaction, or electrostatic interaction.

The solid support can be any suitable composition, such as silica, silica gel, membranes, beaded polystyrene, fretted glass, paper filters, or controlled pore glass.

Yet another embodiment of the invention relates to an interface apparatus for introducing an electrophoretically-separated liquid flow sample into a mass spectrometer as a plurality of charged droplets and a method for using the apparatus to detect and analyze an analyte in a sample. The apparatus includes an interface body which defines a spray chamber and an orifice, and a nanospray needle. The nanospray needle includes a tip having a spray orifice disposed within the spray chamber and a liquid-flow inlet channel. The outer surface of the liquid-flow inlet channel and the inner surface of the nanospray needle define a make-up flow channel.

The invention also encompasses a method for analyzing a sample by electrophoretically separating the components of a sample, introducing at least a portion of the separated components as a liquid flow into the tip of a nanospray needle, introducing a make-up flow into the tip via a make-up flow channel, spraying a plurality of sample droplets into the spray chamber and introducing a sample generated from said plurality of droplets into a mass spectrometer.

BRIEF DESCRIPTION OF THE DRAWINGS

This invention is pointed out with particularity in the appended claims. The above and further advantages of this invention may be better understood by reference to the following description, taken in conjunction with the accompanying drawings, in which:

DETAILED DESCRIPTION OF THE INVENTION

Figure 1:
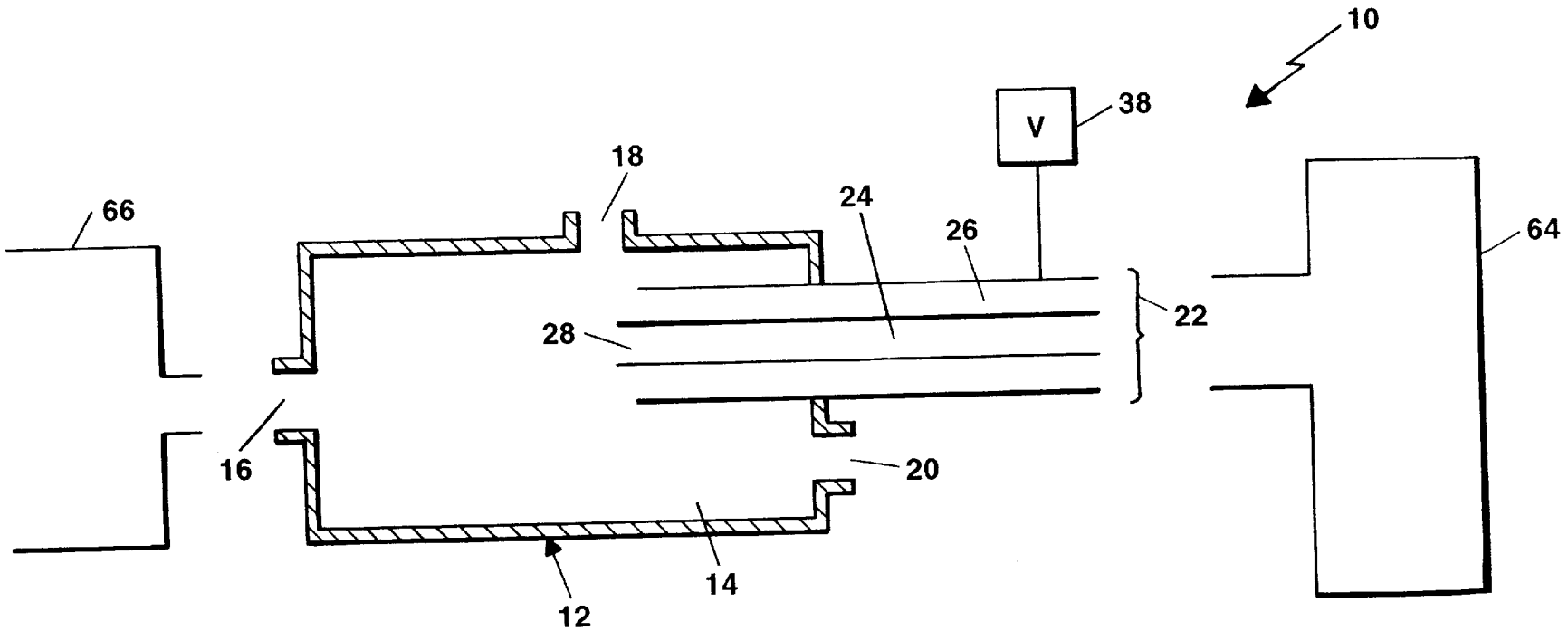
FIG. 1 is a side view of an embodiment of the interface apparatus.

Reference will now be made in detail to the present preferred embodiments of the invention, examples of which are illustrated in the accompanying drawings.

The present invention relates to apparatus, kits and methods for introducing a sample from a liquid flow into a mass spectrometer. Unlike previously known technology, the present invention allows the practitioner to independently regulate (i) the flow rate of sample prior to introduction into the mass spectrometer, and (ii) the rate of introduction of sample into the mass spectrometer. The apparatus of the invention may, in some embodiments, be used as a means for introducing any liquid sample into a mass spectrometry device. Alternatively, the apparatus of the invention may be used to interface another analytical system to a mass spectrometer. For example, it is often desirable to analyze a sample by chromatography or electrophoresis, and then introduce the sample into a mass spectrometer for further characterization and analysis. Although the advantages of combining these various analysis techniques have been recognized in the art, it has been difficult to obtain accurate and complete information due to the difficulties encountered when trying to couple these various techniques.

The claimed invention relates generally to an apparatus suitable for interfacing a liquid flow with a mass spectrometer. The apparatus allows flexibility in coupling a wide range of liquid flow rates with a mass spectrometer, wherein the flow rate of sample into the mass spectrometer is independently optimized. The invention thus allows the practitioner to combine various analysis systems and flow rates while maintaining the sensitivity and resolution of a mass spectrometric analysis Generally, methods and apparatus of the invention provide both a liquid-flow inlet channel and an excess liquid-flow exit channel. The liquid-flow inlet channel can accommodate a very wide range of flow rates, since, according to the invention, excess liquid flow can be redirected, or discarded, via the excess liquid-flow exit channel. Thus, the rate of the sample introduction into the mass spectrometer via electrospray is independent of the rate of liquid flow entering the liquid-flow inlet channel.

I. Apparatus and Methods for Introducing a Sample From a Liquid Flow Into a Mass Spectrometer Referring to FIG. 1, the interface apparatus 10 of the invention for introducing a sample for analysis from a liquid flow into a mass spectrometer comprises an interface body 12 which defines a spray chamber 14 and an orifice 16 for introducing a sample into a mass spectrometer. The apparatus 10 further comprises a spray housing 22 having an open end 28 disposed within the spray chamber 14. Spray housing 22 defines a liquid-flow inlet channel 24, and an excess liquid-flow exit channel 26. Apparatus 10 further comprises a means 38 for applying a voltage to a liquid flow at or near the open end 28.

The interface body 12 may be made from any suitable material, including, but not limited to metal, plastic or glass. It may consist of one, or several layers. In some embodiments, it may be desirable for the interface body 12 to comprise an electrically conductive material such as metal. One skilled in the art can easily determine the preferred material depending upon the particular apparatus or application desired.

Interface body 12 defines a spray chamber 14, which, in turn, defines an orifice 16 for introducing a sample into a mass spectrometer. Orifice 16 may lead directly to the mass analyzer of a mass spectrometer, or, alternatively, may lead to one or several chambers prior to introduction into the mass analyzer of the mass spectrometer. In some instances, the practitioner may pass the sample through one or several chambers having varied physical or chemical conditions to alter or refine the form of the sample to be introduced to the mass analyzer. Such chambers may, for example, be for ion conditioning, ion evaporation, ion formation, or differential pumping. Other conditions which can be altered include, but are not limited to, evaporation, charge transfer, chemical ionization, fragmentation or a chemical reaction step. Physical conditions include, but are not limited to changes in temperature, changes in gas pressure, and changes to various fields including electrostatic fields, electrodynamic fields and/or magnetic fields. Such physical changes can result in the addition of energy to reduce adduct formation or cause fragmentation, or lowering of energy by mild collisions to thermalize or, in conjunction with fields, to allow focusing of ions. Such chambers may vary and can easily be determined by the practitioner depending upon the desired application or apparatus.

Spray chamber 14 is a gas space or vacuum defined by the interface body 12. The spray chamber 14 may be a vacuum, or pressurized by any suitable means or filled with any suitable gas or mixture of gases. For example, in certain embodiments the spray chamber 14 is pressurized by the introduction of a gas such as nitrogen through gas inlet orifice 18, or by allowing gas to exit the chamber via a pressure relief orifice 20.

Figure 2:
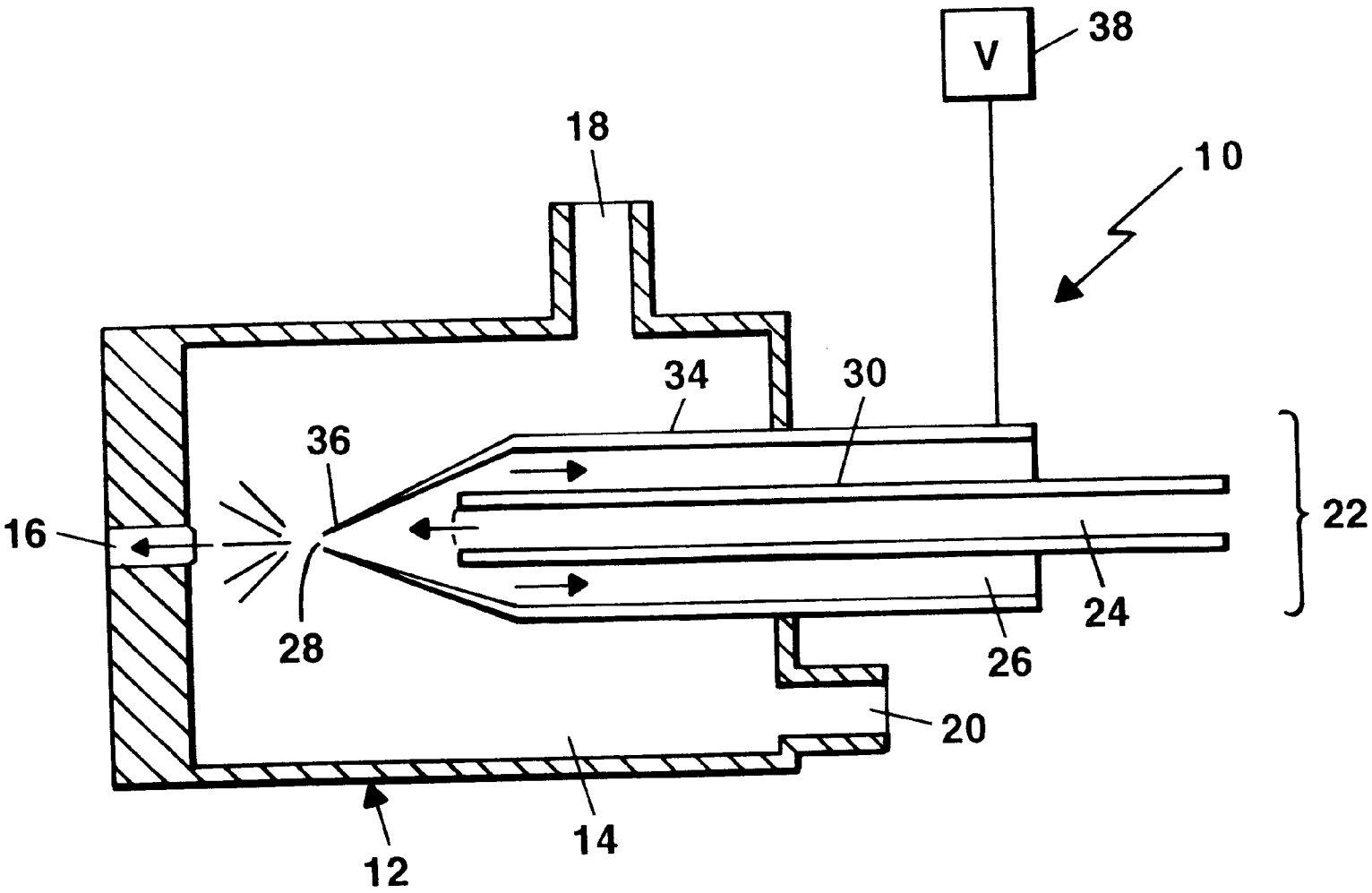
FIG. 2 is a side view of an embodiment of the interface apparatus wherein the spray means comprises an electrospray needle.

Spray housing 22 defines a liquid-flow inlet channel 24, and an excess liquid-flow exit channel 26. Spray housing 22 in various embodiments may comprise a nanospray needle 34, as depicted in FIG. 2. Liquid-flow inlet channel 24 may, in various embodiments, be a capillary or tube made from any suitable material such as, for example fused silica. Excess liquid-flow channel 26 may be a capillary, or, alternatively, may be defined by the outer surface of the liquid-flow inlet channel 24, and the inner surface of the spray housing 22. In certain other embodiments, the spray housing 22 defining liquid-flow inlet channel 24 and excess liquid flow exit channel 26 may be microfabricated in a suitable substrate.

The interface apparatus 10 further comprises a voltage source 38 in electrical communication with the open end 28 of the spray housing 22. Any voltage source known in the art is suitable in the present invention, and can easily be selected by one skilled in the art.

The invention in other embodiments encompasses a method for the on-line detection and/or analysis of an analyte in a liquid flow comprising introducing at least a portion of the liquid flow to be analyzed as a plurality of charged droplets into an apparatus for coupling a liquid flow with a mass spectrometer 66, wherein the apparatus comprises an interface body 12 defining a spray chamber 14, and a spray housing 22 having an open end 28 disposed within said spray chamber, wherein the spray housing 22 defines a liquid-flow inlet channel 24 and an excess liquid-flow exit channel 26. One embodiment of a suitable apparatus for use in the claimed methods is illustrated in FIG. 1, and described in further detail above. Liquid flow is introduced into the interface apparatus through the liquid-flow inlet channel 24. Electrostatic atomization causes at least a portion of the liquid flow to be sprayed into the spray chamber 14.

A sample generated from said plurality of charged droplets is then introduced into the mass analyzer of the mass spectrometer 66 for analysis. A sample generated from the charged droplets means any sample suitable for introduction into the mass analyzer. In some embodiments, the charged droplets formed at the open end of the spray means will be introduced into an ion conditioning chamber via orifice 16 of the mass analyzer without any physical or chemical alterations. In other embodiments, after the charged droplets are formed and sprayed into the spray chamber, the solvent is desorbed from the droplets in the spray chamber, and the analyte passes from the liquid phase into the gaseous phase which includes ions of the analyte constituents. Desorption of the solvent from its association with the droplets can be facilitated thermally, and/or by motion with respect to a gas flow. In other embodiments, the charged droplets may be evaporatively cooled to form ice particles prior to introduction to the mass spectrometer. The skilled practitioner may choose any suitable sample composition depending upon variables such as the sample to be analyzed, the results desired, and the specific apparatus used. The conditions in the spray chamber, and consequently, the form in which the charged droplets enter the mass spectrometer through the spray orifice 16 can be altered by introducing electric fields magnetic fields, nebulizing gases, heating methods, or forming a vacuum or area of reduced pressure. Thus, orifice 16 may in some embodiments lead directly to the mass analyzer of the mass spectrometer or to one or more conditioning chambers.

In methods of the invention, a voltage is applied at the open end of the spray housing to cause at least a portion of the liquid flow to form a spray of charged droplets. There are various methods of applying a voltage to the liquid flow at the open end; means for applying the voltage can be selected based upon the application, apparatus, or preferences of the practitioner. The electrical connection for applying a voltage at the open end can be established, for example, by coating a portion of the spray means with an electrically conductive material. Alternatively, electrical contact may be established through the liquid flow itself, either in the liquid flow inlet channel, or in the excess liquid-flow exit channel. In some embodiments, electrical contact is established through the contact of the outer tube with the liquid flow.

In the methods of the invention, at least a portion of the liquid flow through the liquid flow inlet channel is introduced into the spray chamber, and at least a portion of the liquid flow enters the excess liquid flow exit channel. Although not necessary, a pressure gradient may be imposed on the liquid flow at the open end of the spray housing to induce a portion of the liquid flow to flow from the inlet channel through the excess liquid-flow exit channel. A pressure gradient may be imposed by any method known in the art, such as, for example, adjusting the hydrostatic pressure of the inlet channel or exit channel, adjusting the flow of gas into the spray chamber, or although not presently preferred, introducing a physical impedance into the inlet or exit channel. A sufficient pressure gradient (e.g., a capillary effect) may additionally be imposed by the surface tension of the liquid flow itself, thus causing a portion of the flow to exit through the exit channel. In order to control flow rate into the spray chamber independent of inlet flow, the impedance of the exit channel should be significantly lower than the impedance of the open end.

A. Methods and Apparatus for Interfacing On-line Separation Systems with a Mass Spectrometer In certain embodiments, methods of the invention further comprise separating components of a sample by any separation means known in the art, and then forming a liquid flow comprising at least a portion of the components separated. The liquid flow so formed is then introduced into the interface of the invention. Thus, for example, the invention encompasses a method for the detection and analysis of an analyte in a sample solution comprising the steps of separating components of a sample solution, introducing at least a portion of the separated components as a liquid flow into an apparatus for coupling a liquid flow with a mass spectrometer, wherein the apparatus comprises an interface body defining a spray chamber, and a spray housing having an open end disposed within the spray chamber, and further, wherein the spray housing defines a liquid-flow inlet channel and an excess liquid-flow exit channel. A voltage is applied to the liquid flow at the open end of the spray means to spray a plurality of charged droplets into the spray chamber. A portion of the liquid flows through the exit channel, and a sample generated from the charged droplets is introduced into a mass spectrometer.

Any separation means is suitable for the methods of the invention. Preferred methods include chromatographic separations, such as, for example perfusive chromatographic, and electrophoretic separations. In the apparatus depicted in FIG. 1, the separation means 64 can be any means known in the art, such as, for example, liquid chromatography or capillary electrophoresis.

An additional embodiment of the apparatus of the invention will now be described, where like or similar parts are identified throughout the drawings by the same reference numbers. FIG. 2 is a depiction of a side view of an embodiment of the claimed apparatus wherein spray housing 22 comprises an electrospray needle 34 having an open end 28 disposed in the spray chamber 14. Various types of electrospray needles are known in the art and are suitable for use in the present invention. In embodiments wherein spray means 22 comprises an electrospray needle 34, liquid-flow inlet channel 24 is a capillary positioned inside said needle 34. The capillary may be any suitable size or composition, and may easily be selected by one skilled in the art depending upon the desired application. Inlet channel 24 may be made from any suitable material such as glass, fused silica, Teflon or plastics, metals, i.e. stainless steel, and may be of any suitable dimension. Preferably, the capillary has an inside diameter which ranges from about 1 $\mu$ to about 500 $\mu$, more preferably, about 10 $\mu$ to about 100 $\mu$. In certain embodiments the electrospray needle may be a nanospray needle with a diameter in the range of from about 50 $\mu$ to about 5,000 $\mu$ and a tip orifice diameter from about 1 $\mu$ to about 100 $\mu$, preferably about 5 $\mu$- about 50 $\mu$.

As discussed above, the spray housing or means 22 may be metal coated and provide electrical contact with the liquid flow at the spray orifice. In the embodiment depicted in FIG. 2, the open end of the spray housing 28 is a spray orifice at the tip 36 of the electrospray needle 34. Spray orifice 28 may be any suitable diameter, depending upon the spray rate desired. In this embodiment, at least a portion of the liquid flow through the inlet channel 24 fills the tip 36 of the needle 34, and exits the spray orifice 28 as a plurality of charged droplets. Another portion of the liquid flow through the inlet channel 24 flows through the excess liquid-flow exit channel 26. The "spray flow rate", i.e. the rate of introduction and formation of charged droplets in the spray chamber, is regulated by the combined effects of chemistry, pressure drop and/or the electric field across the nanospray needle as well as its geometry, and is relatively independent of the flow rate through the inlet channel 24.

An embodiment of the interface apparatus 10 may also be used in methods of the invention to trap a particular quantity of liquid flow which contains a sample of interest for repeated mass analysis such as conducting MS/MS or variable fragmentation MS experiments after a peak of interest has been detected by mass spectrometry. This is accomplished by, as above, introducing the components of a liquid flow, into the interface apparatus 10 of the present invention. When the interface apparatus 10 contains a particular quantity of liquid that contains sample of interest, the liquid flow into the interface apparatus 10 is interrupted. Interrupting the liquid flow may be done by closing a valve or shutting off a pump. Formation of a spray of charged droplets can be continued or maintained, as described above, by applying a voltage to the liquid flow at the open end 28 of the spray means 22. To maintain the spray of charged droplets containing the sample of interest, additional liquid is drawn from the excess liquid-flow exit channel 26 to the open end 28 of spray housing 22. Thus, the claimed invention also encompasses a method of performing MS/MS analysis without performing additional LC separations or use of additional sample, and, without the complexity of collecting fractions and reanalyzing them.

II. Apparatus and Methods for Separating and Analyzing a Sample by Capillary Electrophoresis and Mass Spectrometry Preferably, sample components may be separated by capillary electrophoresis (CE). Capillary electrophoresis is known in the art and has been used for a wide variety of analyses including high resolution separations of amino acids, peptides, proteins and complex salt mixtures. It employs a capillary with an electric field gradient to separate the analyte constituents, particularly ions, by differences in electrophoretic mobilities and electroosmotic flows in a capillary. The electrical field causes ions to migrate at a rate dependent upon the electrophoretic mobility of the components. The extent and speed of the separation are determined by differences in the electrophoretic mobilities of the components, the flow rate, partitioning into stationary or pseudo stationary phases, and the strength of the electric field. A skilled practitioner can routinely optimize these variables depending upon the sample to be analyzed and the results desired. Capillary electrophoresis as used herein is meant to include variations such as micellular capillary electrophoresis, isotachophoresis, isoelectric focusing, sieving or electrokinetic chromatography.

FIG. 2 depicts an alternative embodiment of the interface apparatus 10 useful for introducing a sample separated by electrophoretic methods into a mass spectrometer. In this embodiment, however, electrospray needle 34 is a nanospray needle. Spray housing 22 comprises a liquid-flow inlet channel 24 and flow channel 26 is a make-up flow channel. Spray housing 22 can be any apparatus which comprises a liquid-flow inlet channel 24, a make-up flow channel 26 and a nanospray needle 34.

The liquid-flow inlet channel 24 may be disposed inside the needle. The make-up flow channel 26 is preferably defined by a capillary or the space between the inlet channel 24 and the inside of the nanospray needle 34.

The embodiment described above, i.e. comprising a nanospray needle, and a make up flow channel 26 is particularly preferable in methods of the invention utilizing capillary electrophoresis. As discussed above, because of the small volumes of analytes in CE, it may be necessary to add additional flow of liquid prior to introducing a sample into the mass spectrometer. By reversing the flow of liquid in the channel 26 of the claimed apparatus, one can easily add make-up flow to the sample.

In yet other embodiments, the claimed methods comprise a separation by electrophoresis followed by analysis by mass spectrometry. Preferably, in this embodiment the interface apparatus is coupled with a capillary electrophoresis system. In the past, CE/MS was difficult because the flow rates of the CE system were not suitable for optimum MS analysis, and often, additional buffers needed to be added to the sample prior to mass spectrometry. The additional flow of liquid that incorporates appropriate buffers are disadvantageous in that they often degrade detection sensitivity and cause problems associated with maintaining electrical continuity and interference by chemical reaction by-products. Smith et al. have described methods to improve CE/MS detection limits by modifying the concentration of analytes for injection into the mass spec. Analy. Chem. Vol. 65, No. 13 (1993), incorporated by reference. Smith suggested that sensitivity can be optimized using small-diameter capillaries, thus allowing a wide range of CE buffers to be electrosprayed successfully by adding buffers by the sheath liquid or liquid-junction buffer. However, Smith concluded that although the coaxial sheath flow interface facilitated progress somewhat, it contributes electrolytes to the sample that can decrease sensitivity, and gives rise to chemical noise. The methods described by Smith, however, are only capable of detecting high concentrations of analyte in a sample, and are not useful for small sample volumes, or samples having a small concentration of analyte to be detected.

Figure 3:
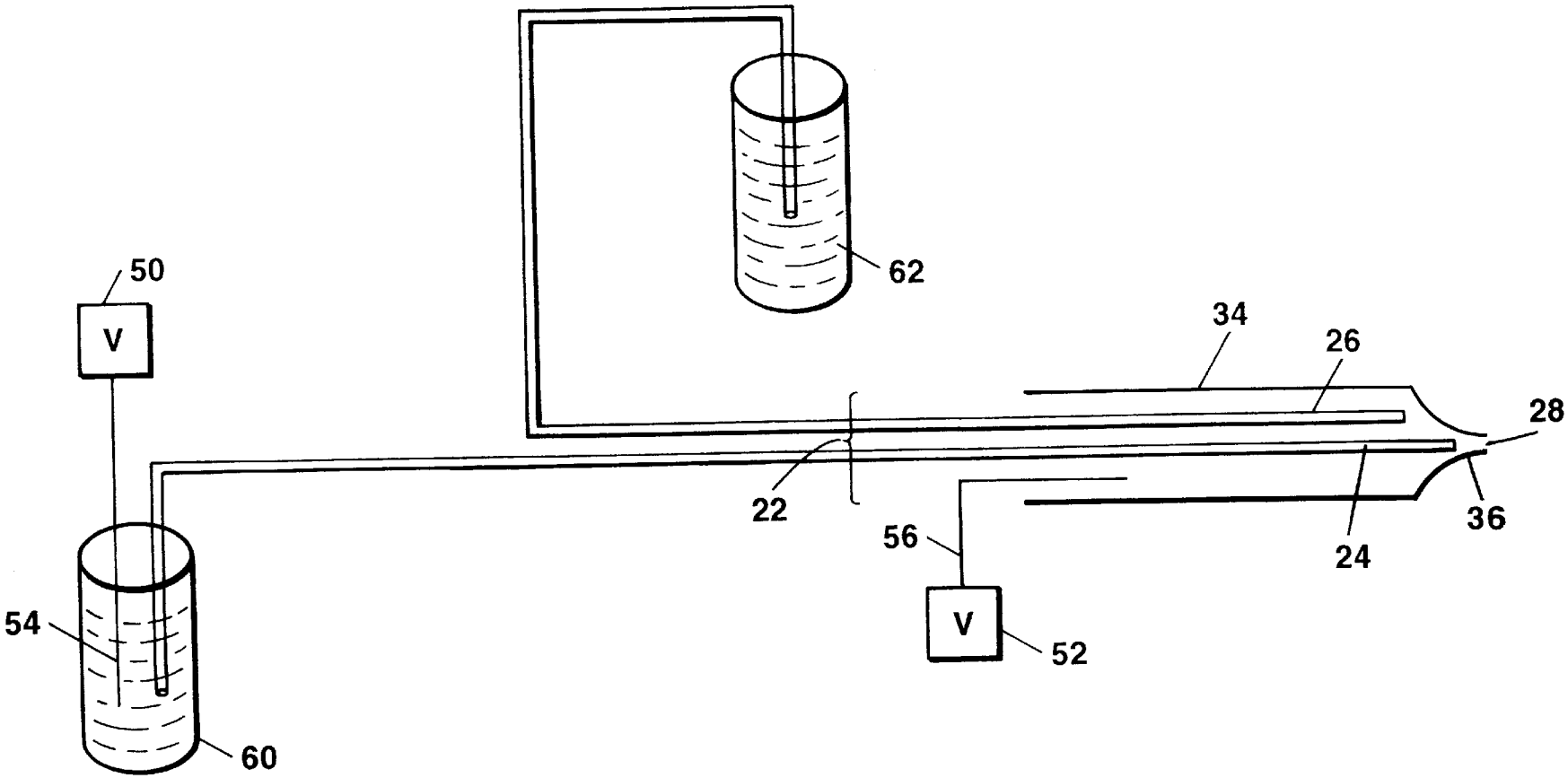
FIG. 3 is a diagrammatic view of the interface apparatus, shown as part of a system for separating sample components by electrophoresis.
Figure 4A:
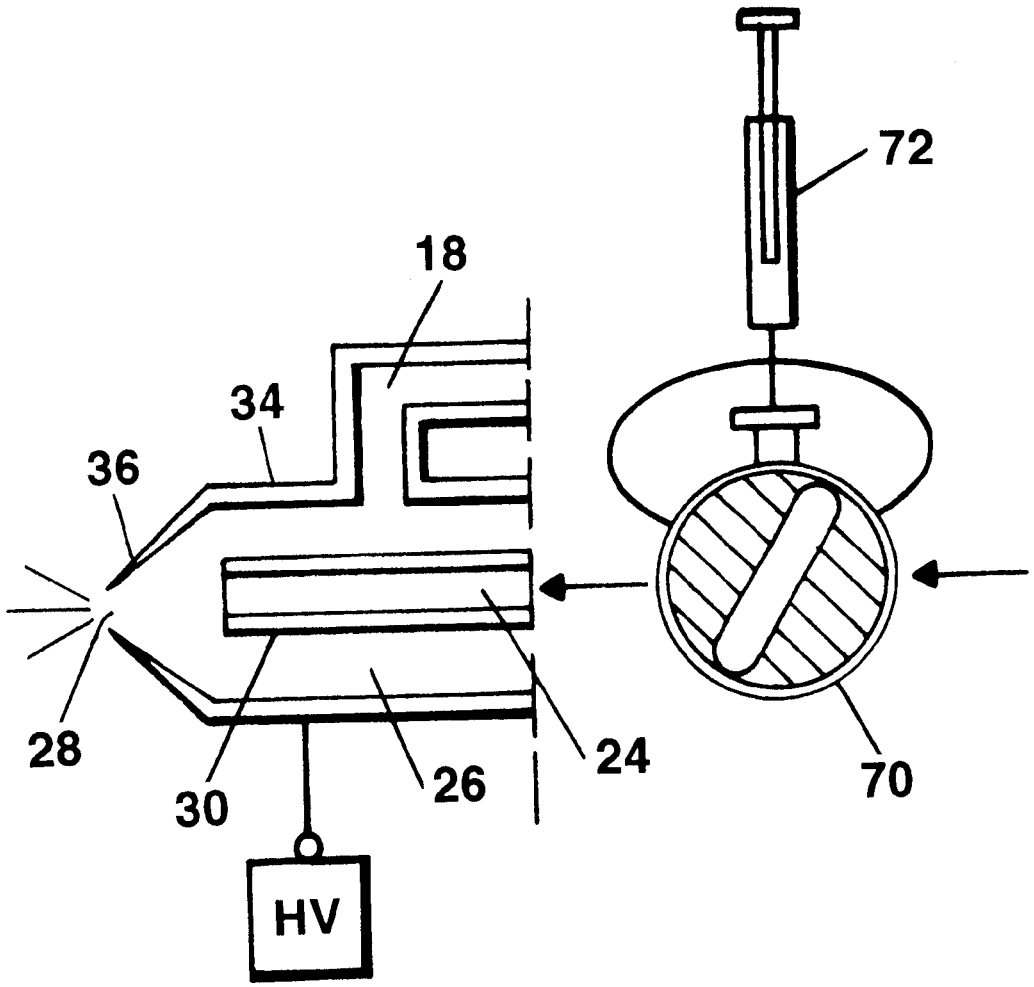
FIG. 4A shows a high-flow interface for peak trapping.
Figure 4C:
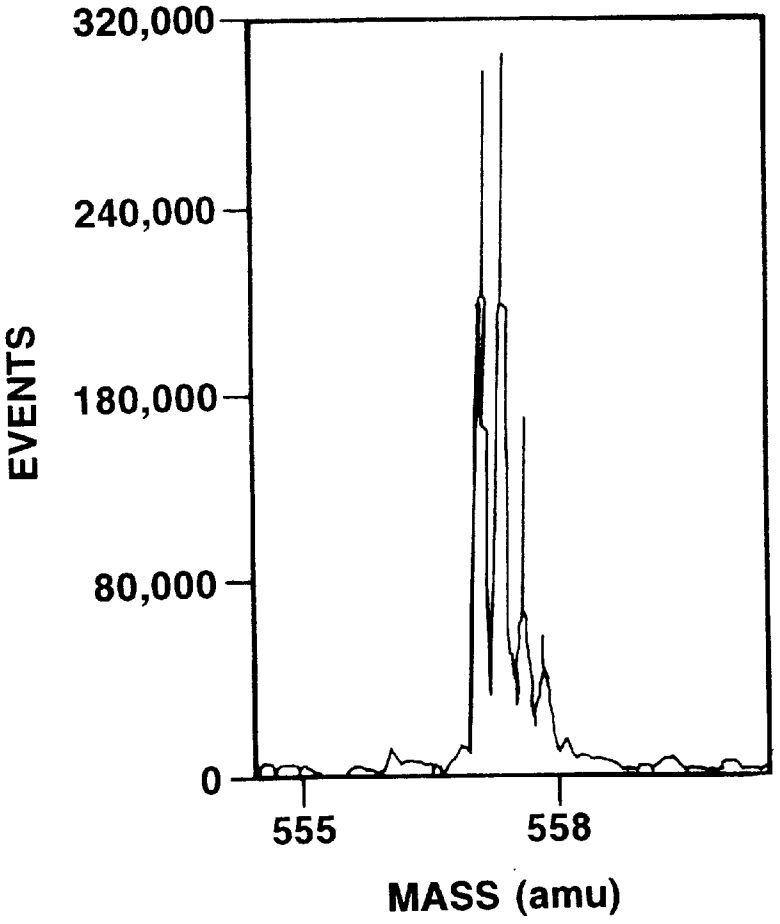
FIG. 4C shows time-of-flight mass spectrometry data obtaining during backflow.
Figure 4B:
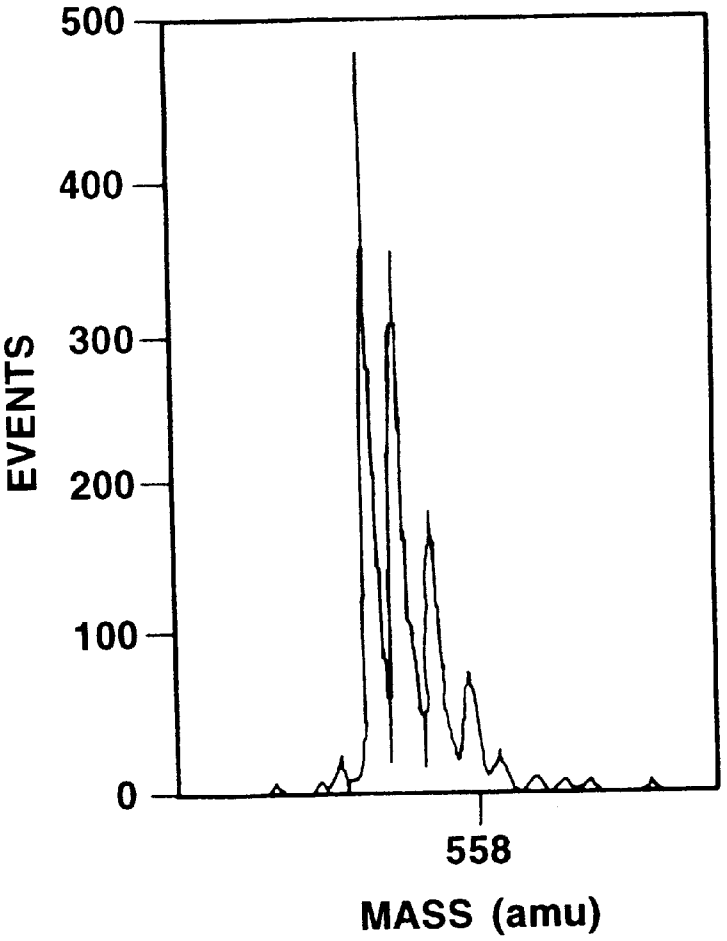
FIG. 4B shows time-of-flight mass spectrometry data obtaining during flow injection.
Figure 4D:
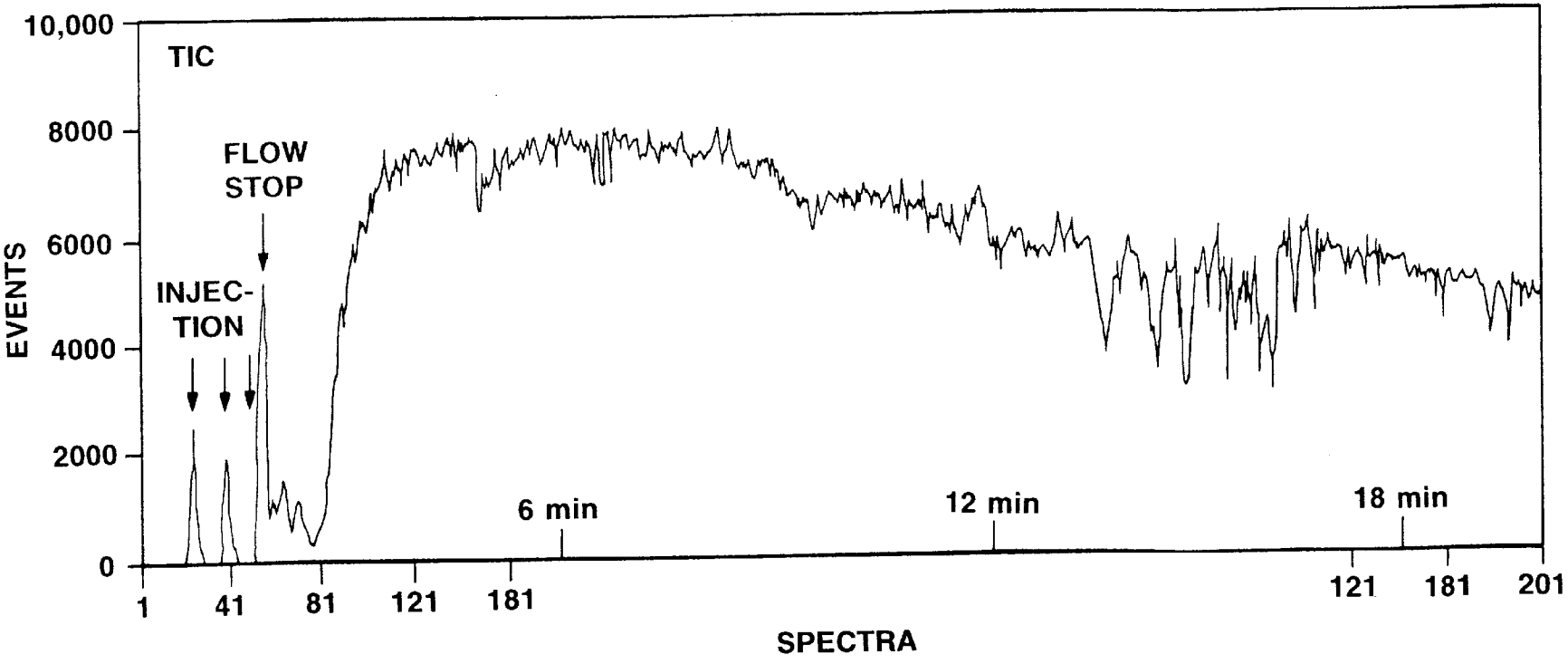
FIG. 4D shows integrated mass spectrometry data obtaining using a device of the invention.

FIG. 3 depicts an embodiment comprising a system for sampling components separated by electrophoresis wherein the make-up flow channel 26 introduces a buffer to the sample. A sample solution from holder 60 is electrophoretically separated in the liquid-flow inlet channel 24. This is achieved by applying a voltage gradient across the liquid-flow inlet channel. FIG. 3 shows one way of applying the voltage gradient. Two voltage sources, 50 and 52, are connected to via electrodes 54 and 56 respectively to opposite ends of liquid-flow channel 24. Holder 60 can alternatively be used to contain sample, or electrophoretic buffer. The voltage gradient applied should be in the kilovolt range, but will vary based on the characteristics of the sample being separated. The resultant voltage gradient separates the sample into its components and moves them along the liquid-flow inlet channel 24 towards the open end 28 of the spray housing 22. A buffer solution 62 is introduced to the spray means 22 via the make-up flow channel 26. The buffer solution 62 is conductive and desirably assists the electrospray or ionization process.

The liquid at the open end 28 of spray housing 22 is sprayed into a spray chamber 14 (not shown in FIG. 3) as a plurality of fine droplets. The charged droplets can be created by electrostatic atomization forcing the liquid through the spray orifice in the needle (electrospray) 34. The voltage difference between source 50 and 52 imposes the voltage gradient across the liquid-flow inlet channel and voltage 52 can also be used to spray the liquid into the spray chamber 14.

An embodiment of the invention that is adaptable as a high-flow liquid chromatography interface, as well as a low-flow capillary electrophoresis interface is also contemplated.

In such an apparatus, the first inlet channel, containing sample for analysis, is positioned coaxially with the second inlet channel, such that flow through the second channel forms a sheath flow over the first channel. This allows mixing of the contents of the two flows at the capillary tip forming the first inlet channel. The sum of the two flows must be equal to or greater than the flow through the open end of the spray chamber. In the case of a liquid chromatography/mass spectrometry interface, the contained flow may be much greater than flow through the open end, with any excess flowing being directed through the exit channel. In any case, flow through the second channel may be zero when conditions are optimal in the first channel.

Figure 6:
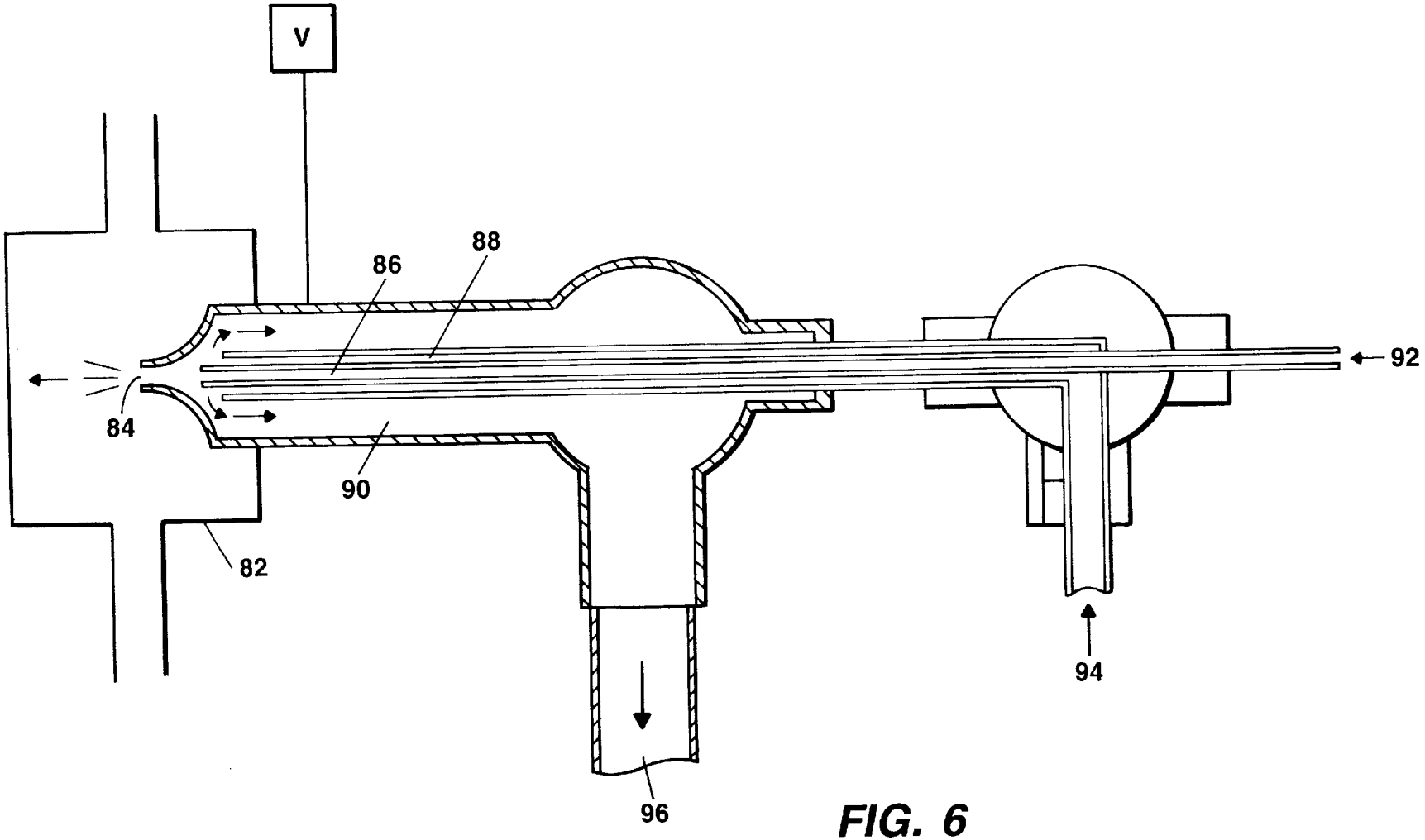
FIG. 6 is a side view of an apparatus of the invention for use as both a high flow and a low flow interface.

FIG. 6 shows such an apparatus comprising a housing 82 defining a spray chamber having an open end 84 and space defining an exit channel 90. Disposed within the chamber are a first inlet channel 86 and a second inlet channel 88. A first liquid sample is introduced in a first liquid inlet orifice 92, and a second liquid sample is introduced into a second liquid inlet orifice 94. Excess liquid flow is forced out of the apparatus through exit or free 96.

EXAMPLE 1

Peak Trapping Using a High-Flow Interface

An interface apparatus of the invention similar to the embodiment depicted in FIG. 2 was constructed by inserting a fused silica capillary (0.25 mm OD by 0.10 mm ID) into a nanospray capillary, comprising a glass tube (1 mm OD by 0.75 mm ID) with the tip drawn to an approximately 5 micron bore. A noble metal coating was placed around the outside of the nanospray capillary to increase electrical conductivity. The fused silica capillary served as an inlet channel; the annular space between the OD of the fused silica capillary and the ID of the glass capillary served as the exit channel; and the 5 micron bore drawn in the nanospray capillary served as the open end of the apparatus. An end of the fused silica tube was inserted into the glass tube as deeply as possible and the opposite end was connected to a standard HPLC injection valve equipped with a 10 uL sample loop. Flow to the injection valve was provided by a syringe pump equipped with a 1 mL syringe and the pump was set to deliver a flow of 50 uL/min. The open end of the glass tube (nanospray capillary) was sealed into one leg of a standard "Tee" fitting, the fused silica tubing into the opposite leg, and the exit channel was coupled via the third leg to a large bore (1.2 mm ID) tube the outer end of which was elevated about two inches above the open end. The flow system is depicted schematically in FIG. 4(*a*).

Examples of data obtained using this interface apparatus with a time-of-flight mass spectrometer are given in FIGS. 4(*b*)–(*d*). In these experiments, the mass spectometer continuously acquired mass spectra in the range from m/z 300 to m/z 5000 with a two second integration time, when a 10 uL solution containing the peptide, neurotensin, was injected. The liquid mobile phase was a 50:50 mixture of methanol and 1% acetic acid in water, the neurotensin sample was prepared at a concentration of approximately 0.1 picomole of peptide per uL of mobile phase. A plot of the total ion current (TIC) detected within a 10 da window centered at m/Z 558 is shown as a function of spectrum number in FIG. 4(*b*). The first two peaks are the responses obtained following injection of the sample. In both cases the peak is about 10 seconds wide at half maximum and the onset is delayed by about 2 seconds from the injection time. This is consistent with the results expected for injection of a 10 uL plug into a flow of 50 uL/min, and there is no evidence of band broadening caused by the interface. A small portion of a spectrum covering the m/z range in which the triply protonated molecular ion of neurotensin is detected is shown in FIG. 4(*c*). This spectrum corresponds to the apex of the peak following the first injection in FIG. 4(*b*).

Following the third injection indicated in FIG. 4(*b*) the flow was stopped by turning off the syringe pump. It took about 10 seconds to completely stop the flow at which time sample in the exit channel begin to flow back into the open end. The signal due to the neurotensin analyte was observed for more than 30 minutes due to this backflow effect with average intensity about three times the maximum intensity observed in the continuous flow case. The integrated intensity of the signal from the stopped-flow experiment is about 600 times the peak intensity observed in the flow injection mode, as can be seen by comparing the integrated spectrum in FIG. 4(*d*) with the single spectrum shown in FIG. 4(*c*).

EXAMPLE 2

Peak Trapping Using a High-Flow Interface

Figure 5:
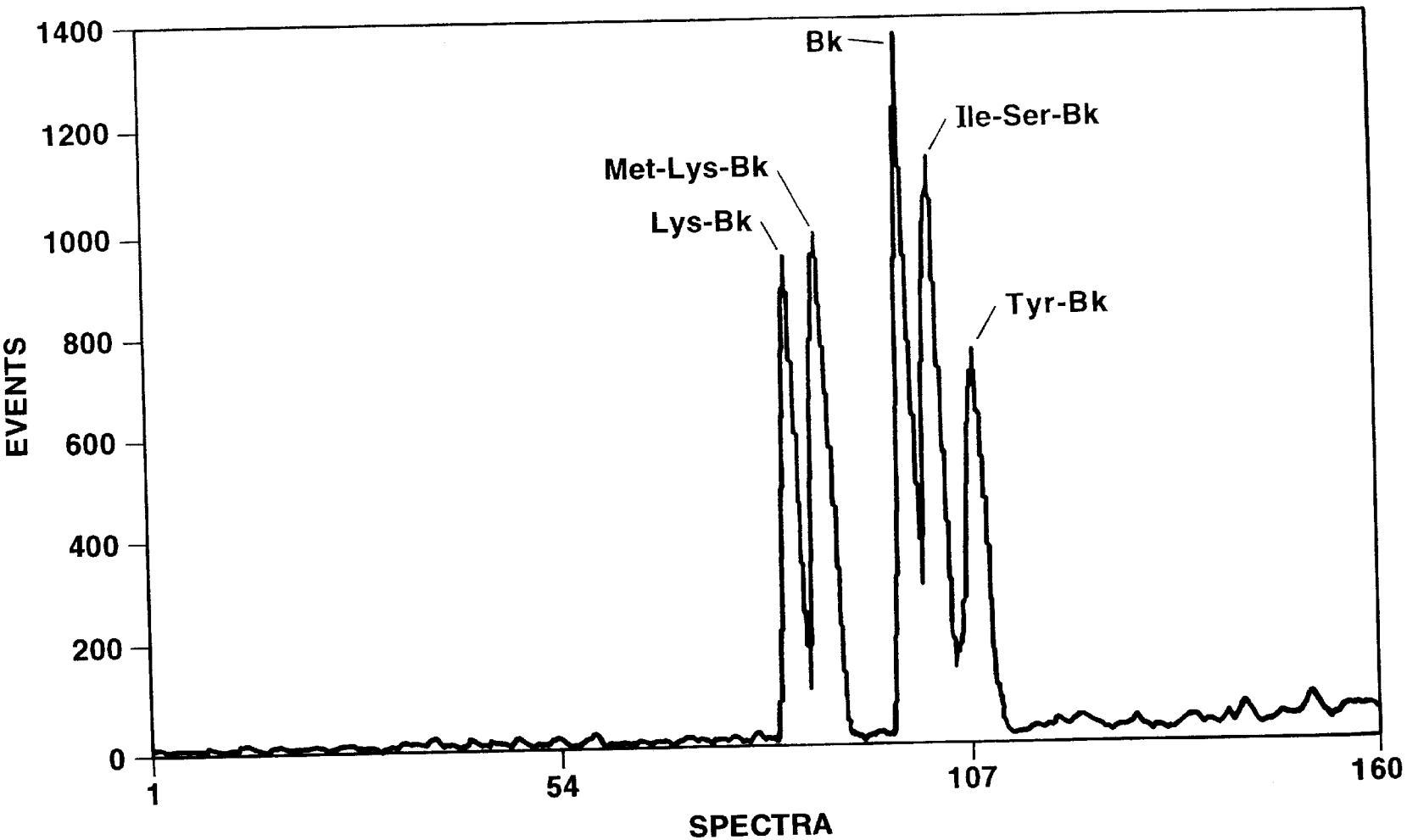
FIG. 5 is an electropherogram showing peak separation obtained during low-flow interfacing.

An interface apparatus according to the invention similar to the embodiment depicted in FIG. 3 was constructed by inserting a fused silica capillary (0.25 mm OD by 0.10 mm ID) and a platinum wire electrode into an uncoated nanospray capillary, comprising a glass tube (1 mm OD by 0.75 mm ID) with the tip drawn to an approximately 5 micron bore. The nanospray needle was filled with a solution comprising a 50:50 mixture of methanol and 1% aqueous acetic acid. The fused silica was filled with a 50 mM aqueous ammonium acetate buffer for capillary electrophoresis. The fused silica capillary served as an inlet channel; the annular space between the OD of the fused silica capillary and the ID of the glass capillary served as a make-up flow channel; and the 5 micron bore drawn in the nanospray capillary served as the open end of the apparatus. An end of the fused silica tube was inserted into the glass tube as deeply as possible and the opposite end was inserted into a holder containing the ammonium acetate buffer. A 2 kV spray voltage was applied to the platinum wire electrode, and a 15 kV separation voltage was applied to an electrode immersed in the holder containing the ammonium acetate buffer. Samples were loaded in the electrophoresis capillary by turning off the 15 kV supply, transferring the outer end of the capillary from the buffer holder to a similar holder containing a solution of the peptide bradykinin and several analogs involving substitution of specific amino acids in the ammonium acetate buffer. The 15 kV supply was then turned on for 2 seconds, and from the known concentration of the peptide solution and earlier calibration experiments, it is estimated that about 500 femtomoles of each peptide was electrophoretically loaded into the capillary. The end of the capillary was then returned to the buffer holder, the 15 kV supply turned on and the ion signal produced was monitored by a time-of-flight mass spectrometer using an integration time of one second per spectrum. The resulting ion signal is plotted as a function of spectrum number in FIG. 5. Complete separation of all five components was accomplished with a total analysis of time of less than three minutes and the performance of neither the time-of-flight mass spectrometer nor the capillary electrophoresis separation was degraded by the interface.

Although only preferred embodiments are specifically illustrated and described herein, it will be appreciated that many other modifications and variations of the present invention are possible in light of the above teachings and within the purview of the appended claims without departing from the spirit of the intended scope of the invention. Other objects, features and advantages of the invention shall become apparent when the following drawings, description and claims are considered.

What is claimed is:

1. An apparatus for introducing a sample into a mass spectrometer comprising a spray chamber having an interior and defining an orifice in communication with a mass spectrometer for introducing a sample into the mass spectrometer at a pre-determined rate; and a spray housing disposed within the spray chamber, the spray housing defining a liquid-flow inlet channel and a liquid-flow exit channel, each of the channels having an end which is in fluid communication with the end of the other channel and the interior of the spray chamber, wherein the liquid-flow inlet channel transports the sample into the spray chamber; and the liquid-flow exit channel directs excess liquid flow from the liquid-flow inlet channel when the flow rate in the liquid-flow inlet channel is greater than the pre-determined rate, and wherein the rate of introduction of the sample into the mass spectrometer is independent of the rate of introduction of liquid comprising the sample into the liquid-flow inlet channel.

2. The apparatus of claim 1 wherein the liquid-flow exit channel encompasses the liquid-flow inlet channel.

3. An apparatus for introducing a sample into a mass spectrometer at a pre-determined rate comprising a spray housing in communication with a mass spectrometer, the spray housing defining a liquid-flow inlet channel and a liquid-flow exit channel, each of the channels having an end which is in fluid communication with the end of the other channel and the mass spectrometer, wherein the liquid-flow inlet channel transports the sample in the spray housing from a sample source; and the liquid-flow exit channel directs excess liquid flow from the liquid-flow inlet channel when the flow rate in the liquid-flow inlet channel is greater than the pre-determined rate, and wherein the rate of introduction of the sample into the mass spectrometer is independent of the rate of introduction of liquid comprising the sample into the liquid-flow inlet channel.

* * * * *